US006068533A

United States Patent [19]

Glickman et al.

[11] Patent Number: 6,068,533

[45] Date of Patent: May 30, 2000

[54] PANEL ELEMENT FOR MULTI-PART CONSTRUCTION TOY

[75] Inventors: Joel I. Glickman, Huntingdon Valley; Charles J. Rodgers, Langhorne, both of Pa.

[73] Assignee: Connector Set Limited Partnership, Hatfield, Pa.

[21] Appl. No.: 09/247,803

[22] Filed: Feb. 8, 1999

[51] Int. Cl.[7] ..... A63H 33/12

[52] U.S. Cl. ..... 446/111; 446/108; 446/116; 446/126

[58] Field of Search ..... 446/108, 111, 446/112, 113, 114, 115, 116, 126

[56] References Cited

U.S. PATENT DOCUMENTS

| | | |
|---|---|---|
| D. 296,344 | 6/1988 | Olsen . |
| D. 297,303 | 8/1988 | Finklestein . |
| D. 304,214 | 10/1989 | Buist . |
| D. 308,705 | 6/1990 | Olsen . |
| D. 309,332 | 7/1990 | Olsen . |
| D. 332,640 | 1/1993 | Pagel . |
| 2,799,118 | 5/1955 | Lullo . |
| 2,972,833 | 2/1961 | La Grutta . |
| 3,177,611 | 4/1965 | Beck . |
| 3,546,807 | 12/1970 | Howe . |
| 3,827,177 | 8/1974 | Wengel . |
| 3,855,748 | 12/1974 | Thomas . |
| 3,927,489 | 12/1975 | Bernstein . |
| 4,129,975 | 12/1978 | Gabriel . |
| 4,253,268 | 3/1981 | Mayr . |
| 4,571,200 | 2/1986 | Serna . |
| 4,787,191 | 11/1988 | Shima . |
| 5,046,982 | 9/1991 | Erickson . |
| 5,061,219 | 10/1991 | Glickman ..... 446/126 |
| 5,100,358 | 3/1992 | Volgger . |
| 5,137,485 | 8/1992 | Penner . |
| 5,183,430 | 2/1993 | Swann . |
| 5,199,919 | 4/1993 | Glickman . |
| 5,575,701 | 11/1996 | Hantman . |

FOREIGN PATENT DOCUMENTS

| | | |
|---|---|---|
| 1281767 | of 0000 | France . |
| 2 040 701 | of 0000 | United Kingdom . |

*Primary Examiner*—Robert A. Hafer
*Assistant Examiner*—Jeffrey D. Carlson
*Attorney, Agent, or Firm*—Schweitzer Cornman Gross & Bondell LLP

[57] ABSTRACT

A panel for a multi-part construction toy characterized by having recesses along some or all of its side edges for the locking reception of connector elements of the type incorporated into standard K'NEX multi-part construction sets. The panels are designed for snap-in assembly of the connectors, enabling panels to be joined edge-to-edge to form a substantially continuous wall structure. With right angle connectors, panels can be joined edge-to-edge at right angles. The panels are also provided with central half slots, enabling two panels to be joined with each other in an X-shaped configuration.

11 Claims, 3 Drawing Sheets

PANEL ELEMENT FOR MULTI-PART CONSTRUCTION TOY

RELATED CASES

This application is related to the subject matter of copending U.S. application Ser. No. 08/943,709, filed Oct. 3, 1997. It is also related to the subject matter of prior U.S. Pat. No. 5,061,219, U.S. Pat. No. 5,137,486, U.S. Pat. No. 5,199,919 and U.S. Pat. No. 5,350,331, all owned by K'NEX Industries, Inc. The subject matter of the foregoing United States patents is incorporated herein by reference.

BACKGROUND AND SUMMARY OF THE INVENTION

This invention is directed to a new and improved construction element for a multi-part construction toy as described in the beforementioned United States patents, known commercially as the "K'NEX" construction toy. In its most fundamental form, the K'NEX construction toy comprises a plurality of rod elements of graduated lengths, and a variety of connector elements engageable with ends of the rods. The rod elements are formed with generally cylindrical ends, provided with annular groove. The connector elements comprise one or more pairs of gripping arms, arranged in a radial array about a predetermined transverse axis. The pairs of gripping arms are formed with grooves for the snap-in reception and tight gripping of the cylindrical end portions of the rods. In addition, each pair of gripping arms is formed with rib-like transverse projections arranged for locking engagement with the annular grooves formed in the rod ends. Assembly of a rod and connector is accomplished by a lateral, snap-in motion of the rod into a pair of gripping arms. Once the snap-in assembly has been completed, the rod is firmly locked against axial movement by the engagement of the transverse projections in the annular groove, and the rod is tightly gripped and held in a predetermined axial alignment by the grooved gripping arms.

In a basic structure of the type described, a relatively open, skeletal structure is formed by the assembled rods and connector elements. In the related copending U.S. application Ser. No. 08/943,709, there is disclosed a form of flat panel element, designed to be incorporated into a K'NEX structural assembly, to provide wall-like structures, and also structural reinforcement for certain types of structures. The panel elements of the copending application incorporate integral rod end elements at corners, arranged to be joined with connector elements to form in the same manner as the usual rod elements.

In accordance with the present invention, a new and improved form of panel element is provided which includes advantageously arranged and located rod end elements for engagement with connector elements, enabling panels to be joined in close, edge-to-edge assembled relation, forming a more continuous wall structure. Additionally, the panels of the invention are adapted for assembly with composite connector assemblies, comprising a pair of connector elements assembled with each other in right angular orientation, whereby two panels may be assembled in close fitting, edge-to-edge relationship, at right angles to each other.

In accordance with another aspect of the invention, the panels may be provided with a centrally positioned slot, extending from one edge of the panel to its center and engageable with a similarly slotted portion of a second panel, enabling assembly of two panels in an "X" configuration. The arrangement and features is such as to enable the new panels to be utilized in a wide variety of structural arrangements.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
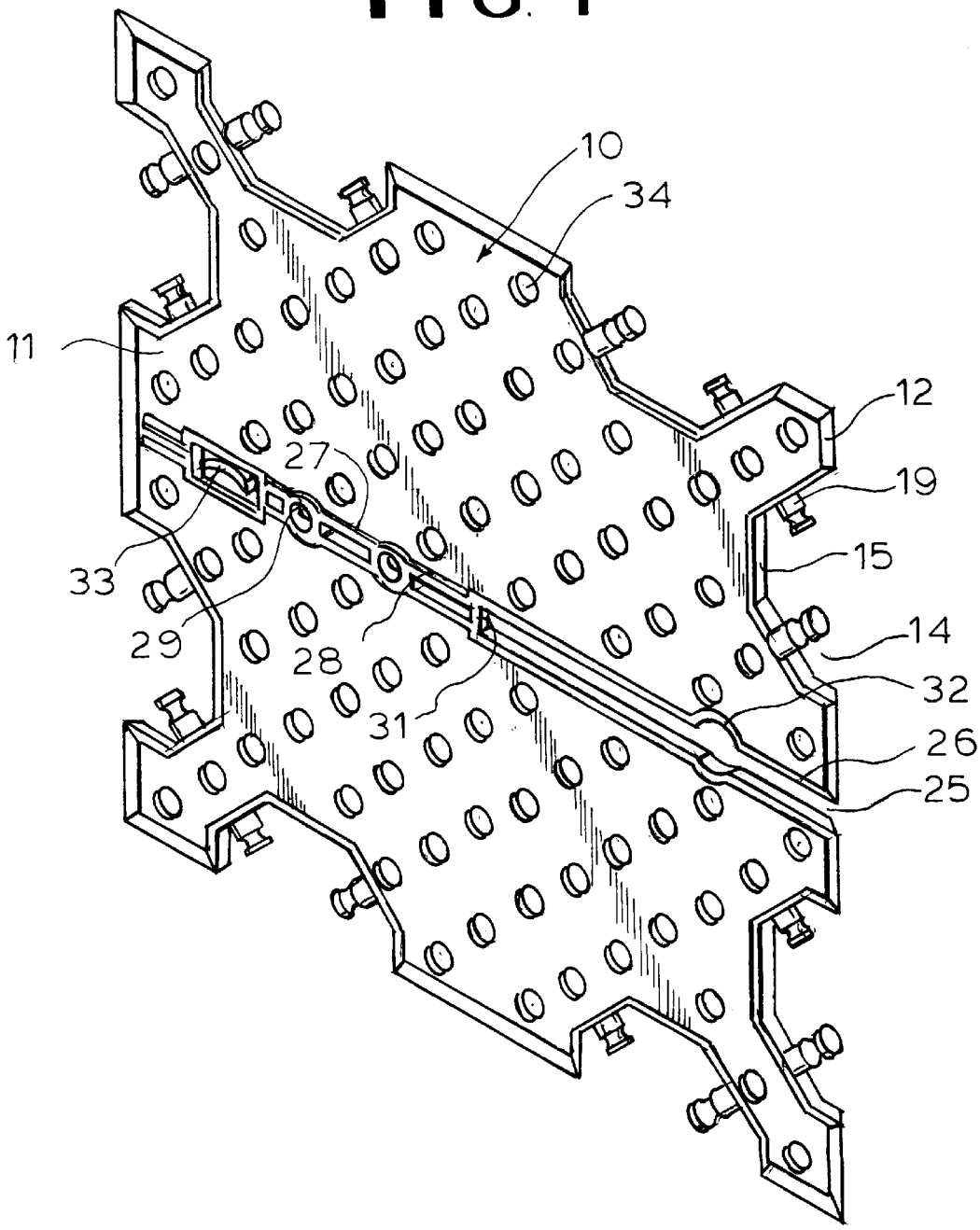
FIG. 1 is a front perspective view of a panel incorporating features of the invention.

Referring now to the drawings, the new panel is designated generally by the reference numeral 10 and is formed of a structural plastic material by injection molding procedures. The illustrated panel 10 is of a generally rectangular, preferably square configuration and, for conformance with the standard dimensional aspects of the K'NEX construction toy system, the illustrated "large" panel measures approximately 5.87 inches on a side. The panel has a thin flat central body portion 11, having a typical thickness of about 0.060 inch surrounded by a peripheral stiffening flange 12 of about 0.246 inch in thickness. As reflected in FIG. 4, the peripheral flange 12 has side walls 13 disposed at a 45° angle to the plane of the body 11 to accommodate assembly of panels in right angular orientation, with their respective peripheral flanges 12 in abutting or substantially abutting relation.

Each of the edges of the panel 10 is provided with spaced apart recesses 14 which are defined by peripheral flanges 15 to be of semi-octagonal configuration. The size and shape of the recesses 14 is calculated to be such as to closely receive one half of a standard eight-position connector 16 of a K'NEX construction set. As described in, for example, U.S. Pat. No. 5,199,919, the connector 16 is formed with eight pairs of gripping arms 17, forming eight, angularly arrayed sockets for the reception of rod elements 18, which can be of any of a plurality of graduated lengths.

In each of the recesses 14, there are provided two integral rod end elements 19 arranged at an angle to each other, preferably at 90°, with their axes intersecting at a point 20 which lies generally along the projected line of the outside of the peripheral flange 12. The size and shape of the rod end elements 19 correspond to the ends of standard K'NEX rod elements, and thus are adapted for snap-in, locking assembly with a connector element.

Figure 3:
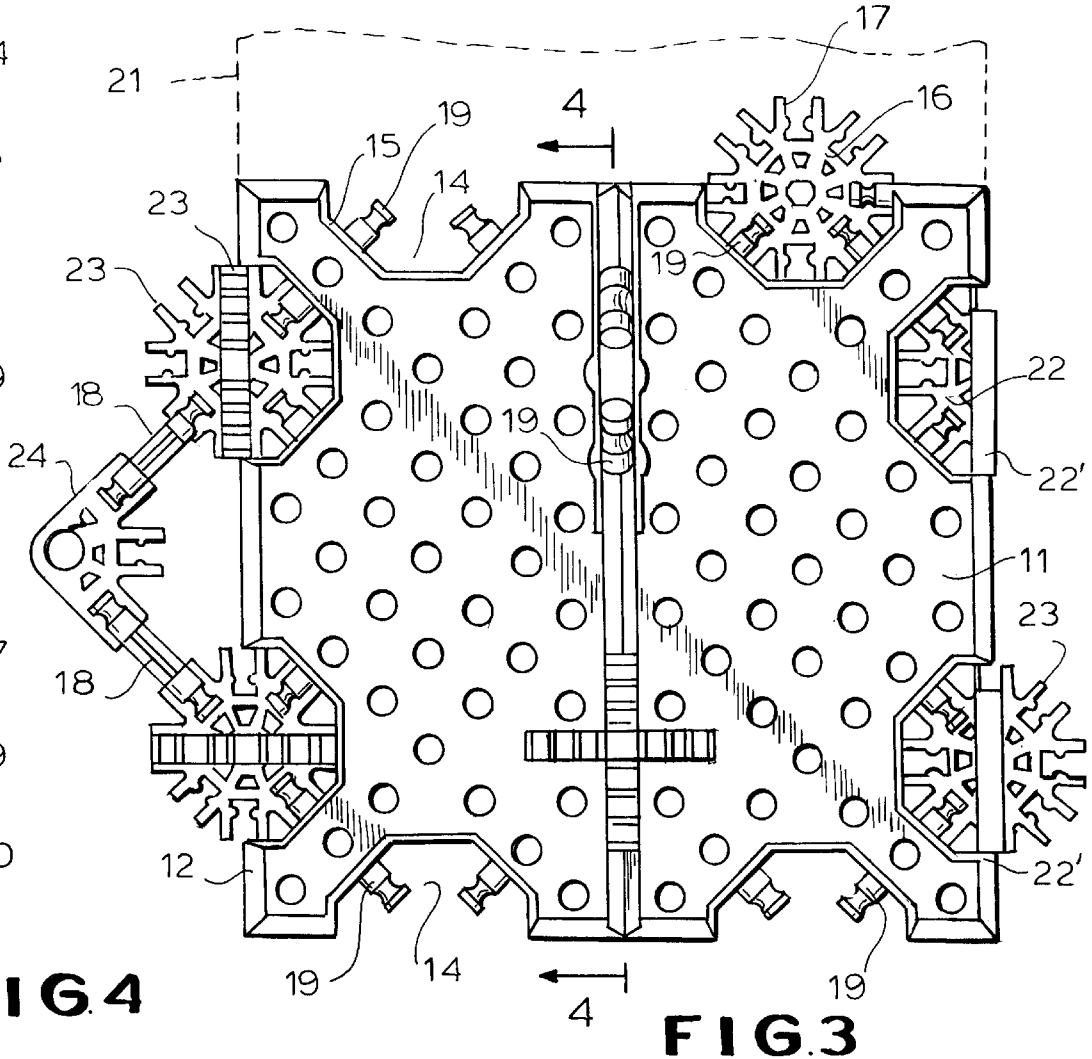
FIG. 3 is an elevational view of an assembly of panels of FIG. 1, joined together in an X configuration and assembled together with various types of connector elements.

With reference to FIG. 3, the eight-position connector 16 is shown in assembled relation with the panel 10 in the recess 14 at the upper right-hand area of the panel. Two of the pairs of gripping arms of the connector are assembled with the rod ends 19 such that the connector element is tightly attached to the panel. Because the two rod ends 19 are arranged with their axes intersecting at an angle, the connector element 16 is locked in place in a fixed plane. The axes of the rod end elements 19 lie in the plane of the panel body 11, such that the connector element is fixed with its center plane coincident with the center plane of the panel body.

Figure 4:
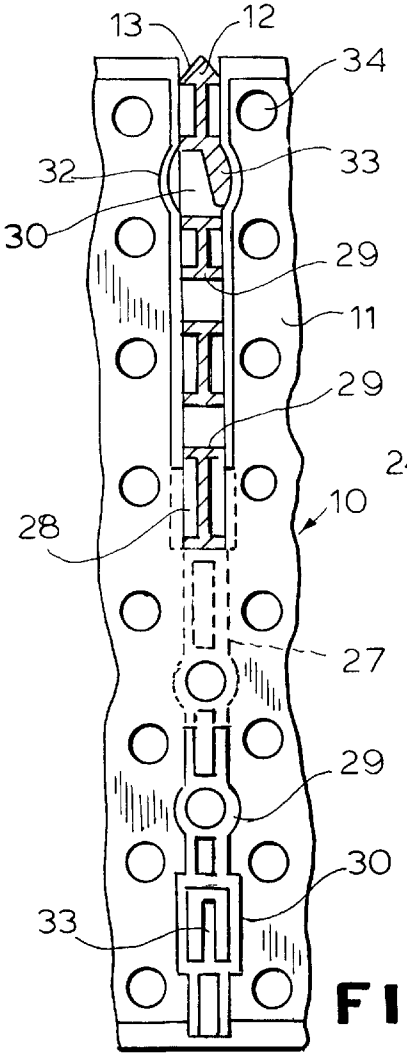
FIG. 4 is an enlarged, fragmentary, cross sectional view as taken generally on line 4—4 of FIG. 3.

As shown in FIG. 4, when the connector element 16 is installed, half of the eight-position connector extends outward beyond the peripheral flange 12 of the panel. Accordingly, a second panel 21 may be joined to the first in an edge-to-edge relation by assembling the second panel with the exposed portion of the connector element. Typically, in a panel of the size illustrated, adjacent panels 10, 21, arranged in edge-to-edge abutting relation in a common plane, would be joined by a pair of eight-position connectors, one in each of two adjacent recesses 14.

As described in more detail in the beforementioned U.S. Pat. No. 5,199,919, the K'NEX construction set includes special connector elements arranged to be joined together in right angular orientation, to form a composite connector assembly having pairs of rod gripping elements arrayed in two right angularly related planes. One example of such connectors is shown at 22, 22' in FIG. 3. Each of the connector elements 22, 22' comprises four pairs of gripping arms disposed in a common plane and arrayed at a 45° angular spacing. When two such connector elements are joined, the composite connector comprises three pairs of gripping arms arrayed at 45°, disposed in one plane, and three similar pairs of gripping arms disposed in a second plane at right angles thereto. Two additional pairs of gripping arms are disposed at opposite sides of the composite connector, lying along an axis formed by the intersection of the two planes.

When an assembly of connector elements 22, 22' is joined with a panel 10, as shown along their upper right-hand edge of the panel in FIG. 3, one of the connector elements is fixed in the plane of the panel 10, and the second connector 22', identical to the connector 22, extends at right angles thereto. An additional panel (not shown) can be joined with the connector 22' in exactly the same manner as the panel 10 is joined with the connector 22, thus fixing the two panels in right angular orientation. As in the case of the panel 21, joined in the same plane as the panel 10, it normally would be desirable to join the panels using connectors installed at both recess sites.

Because outer surfaces 13 of the peripheral flange 12 are disposed at 45° to the panel plane, a pair of panels may be joined edge-to-edge, in a right angular orientation, with their angular outer surfaces 13 in substantially abutting relation.

As described in the beforementioned U.S. Pat. No. 5,199,919, composite connector assemblies, with connector elements disposed at right angles, can be provided in other combinations. For example, connector elements 23, 23', shown at the upper left of the panel 10 in FIG. 3, join two connectors, each with seven pairs of gripping arms arrayed with 45° angular separation. When two such connector elements are jointed at right angles, each provides six pairs of gripping arms arrayed in a plane, with one plane disposed at right angles to the other, and two common sets of gripping arms located along an axis formed by the intersection of the two planes. With such an arrangement, it is possible to join four panels edge-to-edge, with two of the panels being disposed at right angles to the other two.

In yet another composite connector assembly, a connector 23, with seven pairs of gripping arms, is joined with a connector 22' with four pairs of gripping arms. This combination enables three panels to be joined, two such panels being joined edge-to-edge in the same plane, by assembly to the connector 23 while a third panel may be joined at right angles thereto, by assembly to the connector 22'.

As will be readily understood, it is not necessary that connector elements, installed in the panel recesses 14, be utilized for the joining of other panels. The connectors thus installed may also be utilized in conjunction with the assembly of rod elements and other connector elements 24, as shown along the left side of the panel 10 in FIG. 3, to form the more customary skeletal structure formations of the K'NEX construction set.

In a particularly preferred embodiment of the invention, provision is made for interfitting of one panel with another, without the use of connector elements, to form an X-shaped assembly of panels disposed at right angles. In the illustrated form of the invention, each panel is formed with a central slot 25, extending from one peripheral flange (at the right in FIG. 1) to the center of the panel, along a line parallel to the edges of the panel and midway therebetween. The edges of the slot 25 are defined by flanges 26, which are preferably of the same width dimension (in a direction perpendicular to the plane of the panel) as the peripheral flange 12. The width of the slot 25, between opposed flanges 26, substantially equals the overall thickness dimension of a panel 10 as reflected by the width of its peripheral and other flanges 12, 15 and 26. With this construction, a second panel, configured in the same manner, can be assembled crosswise with a first panel, with the slotted portion 25 of each panel embracing the unslotted portion 27 of the panel which is aligned with its slot. Such an assembly of panels is illustrated in FIG. 3, and in somewhat more detail in FIG. 4. The two panels thus assembled form a desired X-shaped configuration.

Figure 2:
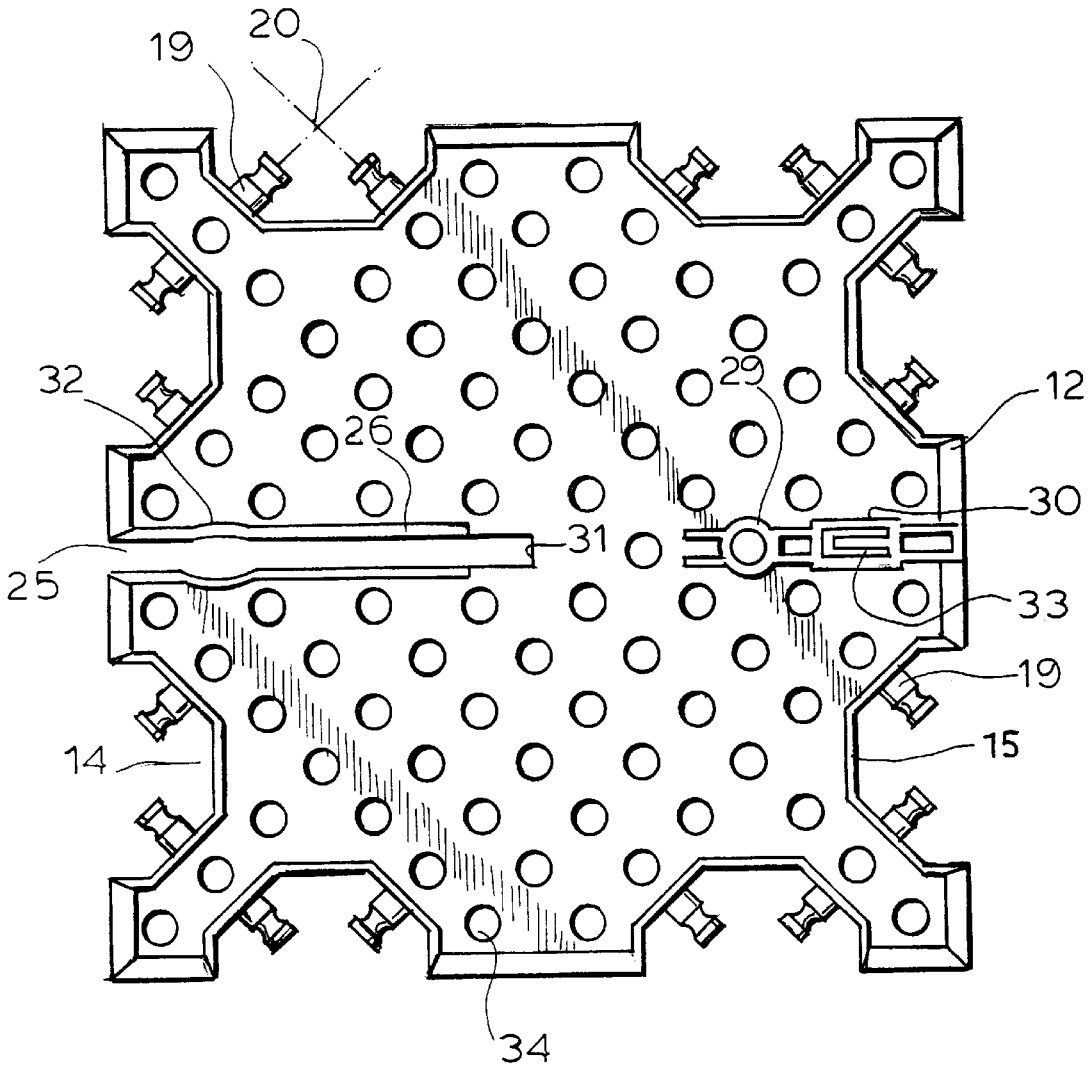
FIG. 2 is a back elevational view of the panel of FIG. 1.

To advantage, the unslotted portion 27 of the panel, which is aligned with the slotted portion, is formed with internal flanges 28–31, increasing the effective thickness of the panel in this area to substantially equal the width of the slot 25. The various flanges 26 and 28–31, for the most part, extend equally from both sides of the panel body 11. However, on one side of the panel, evident in FIG. 2, the flanges may be eliminated in the centermost regions of the panel to facilitate optimum gating of the mold for the inflow of material during the injection molding process.

When two such slotted panels are assembled in an X-shaped configuration, the two panels are pressed together until the bottom flange 31 of each slot abuts with the bottom flange of the other to fix the assembled position of the panels.

To advantage, detent means may be incorporated in the panels to retain them in a fully assembled position. To this end, the side flanges 26 defining the slot 25 are formed with recess portions 32, and the unslotted extension 27 is provided at a corresponding location with a resilient detent element 33 positioned within an opening defined by the flange elements 30. The detent element 33, shown in more detail in FIG. 4, is integrally joined at one end only with the body of the panel and normally projects laterally away from the panel body. When two panels are joined by their slots, as shown in FIG. 4, the detent elements at opposite ends are temporarily elastically displaced during the assembly operation and, when the respective panels are fully seated, the detent elements press outward into the recesses 32 such that the assembled panels will remain in their assembled relationship in the absence of sufficient force to overcome the detent.

As reflected in the drawings, the panel bodies 11 may be provided with a plurality of circular openings 34 over the surface of the panel body. These are desirable to reduce the weight of the element and the material required for its production. In addition, the openings desirably are of a size to closely receive a standard rod element of the K'NEX construction set, enabling the openings to be used functionally in a structural assembly.

It should be understood, of course, that the specific forms of the invention herein illustrated and described are intended to be representative only, as certain changes may be made therein without departing from the clear teachings of the disclosure. Among other things, features of the invention may be utilized to advantage with panels of other than square or ectangular shape. Accordingly, reference should be made to the following appended claims in determining the full scope of the invention.

I claim:

1. A panel for a multi-part construction toy, wherein the construction toy comprises a plurality of rods of different standard lengths and a plurality of connector elements, the rod elements having generally cylindrical end portions and annular grooves in said end portions defining an end flange, and the connector elements comprising a plurality of radially disposed and angularly spaced pairs of opposed and laterally spaced gripping arms joined at inner ends thereof and defining a connector plane, outer portions of said gripping arms having axial grooves for the snug reception and axial alignment of a rod element, inner portions of said gripping arms having lateral projections for cooperation with said annular grooves for axial positioning of said rod elements, the panel comprising (a) a flat body portion having side edges and corners and defining a panel plane, (b) a recess in one side edge of said body portion, (c) said recess being of a size and shape to receive a portion of a connector element including at least two pairs of gripping arms thereof, (d) said recess having a radial center point positioned substantially coincident with said one side edge, (e) a plurality of rod end elements integrally formed with said body portion and extending into said recess along radius lines intersecting with said radial center point, (f) said rod end elements being configured in the form of ends of said rod elements and being spaced apart on said radius lines according to the same spacing as gripping arms of a connector element, (g) said rod end elements being adapted to be engaged by pairs of gripping arms of a connector element to firmly lock said connector element to said panel with the plane of said connector element being parallel to the plane of said panel.

2. A panel according to claim 1, wherein (a) said panel is formed with a centrally disposed slot extending from one side edge thereof to the center thereof and adapted for cooperation with a similar slot of a second such panel to form an X-shaped assembly of such panels.

3. A panel according to claim 1, wherein (a) each of the side edges of said panel is formed with a recess and rod end elements for the reception and engagement of a connector element.

4. A panel according to claim 3, wherein (a) each of the side edges is formed with a spaced-apart pair of recesses and rod end elements for the reception and engagement of connector elements, (b) the spacing between centers of adjacent recesses on a side edge is equal to the spacing between centers of two connector elements when joined by a rod element of standard length.

5. A panel according to claim 4, wherein (a) the spacing from the center of a recess to the lateral side edge of the panel is one half the spacing between centers of adjacent recesses.

6. A panel according to claim 1, wherein (a) the body portion of said panel is flat and relatively thin, (b) said side edges being defined by enlarged edge flanges of substantially greater thickness than said body portion.

7. A panel according to claim 6, wherein (a) said edge flanges are of triangular cross sectional configuration with base portions thereof facing inward and being oriented at right angles to the plane of said panel and apex portions facing outward and forming a 90 degree angle bisected by the plane of said panel, to accommodate positioning a pair of said panels at right angles to each other with edge flanges thereof abutting along a 45 degree plane.

8. A panel according to claim 7, wherein (a) a pair of panels, positioned at right angles to each other and with edge flanges abutting, is joined by a pair of composite connectors, (b) each composite connector comprising a pair of connector elements joined at right angles and having pairs of gripping arms arrayed in two right angularly related planes, (c) one connector of each pair being engaged with one of the panels of said pair.

9. A panel according to claim 2, wherein (a) said panel is formed with detent means engageable with a second panel when a pair of such panels is combined to form an X-shaped assembly.

10. A panel according to claim 9, wherein (a) said detent means includes a detent recess formed in said slot at a predetermined distance from the center of said panel, and (b) a resilient detent element formed in said panel at a point aligned with said slot and spaced from the center of said panel a distance generally equal to the spacing of said detent recess from said center, whereby (c) when a pair of panels in joined in an X-shaped assembly, the detent element of one panel will be received in the detent recess of the other panel.

11. A panel according to claim 1, wherein (a) said panel is of rectangular configuration and is formed with connector-receiving recesses on all side edges thereof.

* * * * *